US011725440B2

(12) United States Patent
Bai

(10) Patent No.: US 11,725,440 B2
(45) Date of Patent: Aug. 15, 2023

(54) PULLEY DEVICE, SLIDING DOOR AND SLIDING WINDOW

(71) Applicant: GUANGDONG KIN LONG HARDWARE PRODUCTS CO., LTD, Dongguan (CN)

(72) Inventor: Baokun Bai, Dongguan (CN)

(73) Assignee: GUANGDONG KIN LONG HARDWARE PRODUCTS CO., LTD, Dongguan (CN)

( * ) Notice: Subject to any disclaimer, the term of this patent is extended or adjusted under 35 U.S.C. 154(b) by 0 days.

(21) Appl. No.: 17/565,296

(22) Filed: Dec. 29, 2021

(65) Prior Publication Data

US 2022/0235593 A1 Jul. 28, 2022

(30) Foreign Application Priority Data

Jan. 22, 2021 (CN) ..... 202110088441.1

(51) Int. Cl.
*E05D 15/06* (2006.01)
*E06B 3/46* (2006.01)

(52) U.S. Cl.
CPC ..... *E05D 15/0669* (2013.01); *E06B 3/4609* (2013.01); *E06B 3/4636* (2013.01);
(Continued)

(58) Field of Classification Search
CPC . E05D 15/0669; E05D 15/0634; E05D 13/00; E05D 13/003; E05D 15/0652;
(Continued)

(56) References Cited

U.S. PATENT DOCUMENTS 4,006,513 A * 2/1977 Offterdinger ..... E05D 15/0669 49/420
4,262,451 A * 4/1981 Dallaire ..... E05D 15/0669 16/99

(Continued)

FOREIGN PATENT DOCUMENTS

CN 102619425 A 8/2012
CN 203022489 U 6/2013

(Continued)

OTHER PUBLICATIONS

European Search Report dated May 31, 2022 for corresponding European application No. 21217570.7, pp. 1-9.

(Continued)

*Primary Examiner* — Justin B Rephann
(74) *Attorney, Agent, or Firm* — Intellectual Property Law Group LLP

(57) ABSTRACT

The present disclosure relates to a pulley device, a sliding door, and a sliding window. The pulley device includes: a pulley component including a pulley; a connecting component including a rocker, one end of the rocker being rotatably connected to the pulley component; and a housing including a bottom plate and two side plates. The two side plates are fixed to two opposed sides of the bottom plate, respectively, so that the bottom plate and the side plates jointly define a receiving cavity configured to receive the pulley component and the connecting component. A surface of the side plate facing the receiving cavity defines a receiving groove along a length direction of the side plate, and the other end of the rocker is received in the receiving groove and is capable of sliding along the receiving groove.

18 Claims, 4 Drawing Sheets

(52) U.S. Cl.
CPC ..... *E05Y 2201/10* (2013.01); *E05Y 2900/132* (2013.01); *E05Y 2900/148* (2013.01)

(58) Field of Classification Search
CPC . E05D 15/0665; E06B 3/4609; E06B 3/4636; Y10T 16/3834; Y10T 16/3816; E05F 5/003; E05F 1/16
See application file for complete search history.

(56) References Cited

U.S. PATENT DOCUMENTS

| | | | | |
|---|---|---|---|---|
| 5,161,330 | A * | 11/1992 | Auriemma | E05D 15/0669 49/420 |
| 5,791,089 | A * | 8/1998 | Prevot | E05D 15/0669 49/425 |
| 5,860,189 | A * | 1/1999 | An | E05D 15/0669 16/105 |
| 10,711,497 | B2 * | 7/2020 | Lang | E06B 3/46 |
| 10,738,521 | B2 * | 8/2020 | Hamilton | E05D 15/0634 |
| 2005/0011041 | A1 * | 1/2005 | Ness | E05D 15/0669 16/105 |
| 2010/0031577 | A1 * | 2/2010 | Haab | E05F 5/003 49/449 |
| 2013/0205542 | A1 * | 8/2013 | Backman | E05D 15/0634 16/102 |
| 2014/0150209 | A1 * | 6/2014 | Tidwell | E05D 15/0669 16/100 |
| 2014/0310913 | A1 * | 10/2014 | Horwood | E05D 15/0669 16/100 |
| 2015/0211276 | A1 * | 7/2015 | Gabriel | E05D 15/0621 49/456 |
| 2016/0273253 | A1 * | 9/2016 | Zimmer | E06B 3/4636 |
| 2016/0273254 | A1 * | 9/2016 | Zimmer | E05D 15/0669 |
| 2018/0058122 | A1 * | 3/2018 | Lang | E06B 3/46 |
| 2018/0283070 | A1 * | 10/2018 | Hamilton | E05D 15/0669 |

FOREIGN PATENT DOCUMENTS

| | | | |
|---|---|---|---|
| CN | 203626479 | U | 6/2014 |
| CN | 203808695 | U | 9/2014 |
| CN | 204040714 | U | 12/2014 |
| CN | 204531817 | U | 8/2015 |
| CN | 206309186 | U | 7/2017 |
| CN | 107191084 | A | 9/2017 |
| CN | 209924710 | U | 1/2020 |
| CN | 211736807 | U | 10/2020 |
| JP | 2017057554 | A | 3/2017 |
| WO | WO 2018/019415 | A1 | 2/2018 |

OTHER PUBLICATIONS

China Office Action dated Feb. 18, 2022 for corresponding China application No. 202110088441.1 with English translation pp. 1-9.
China Office Action dated Nov. 18, 2022 for corresponding China application No. 2021100884411 with English translation, pp. 1-15.

* cited by examiner

PULLEY DEVICE, SLIDING DOOR AND SLIDING WINDOW

CROSS-REFERENCE TO RELATED APPLICATION

This application claims to the priority of Chinese Patent Application No. 2021100884411, filed on Jan. 22, 2021, the entire contents of which is incorporated herein by reference.

TECHNICAL FIELD

The present disclosure relates to the technical field of door or window fittings, in particular to a pulley device, a sliding door, and a sliding window.

BACKGROUND

With the development of related technologies, sliding doors and sliding windows have become more and more widely used in people's daily life. Therefore, manufacturers and users have continuously improved the performance requirements of pulley devices for smooth sliding of the sliding doors and the sliding windows.

In the conventional technology, in order to realize the adjustability of the pulley device, structures used to mount and position the pulley device are relatively complicated, resulting in that the pulley device is not easy to be mounted and detached, and the production cost is high, which greatly limits the application range of the pulley device.

SUMMARY

According to various embodiments, a pulley device, a sliding door, and a sliding window are provided.

According to embodiments of the present disclosure, a pulley device is provided. The pulley device includes: a pulley component including a pulley; a connecting component including a rocker, one end of the rocker being rotatably connected to the pulley component; and a housing including a bottom plate and two side plates. The two side plates are fixed to two opposed sides of the bottom plate, respectively, so that the bottom plate and the side plates jointly define a receiving cavity configured to receive the pulley component and the connecting component. A surface of the side plate facing the receiving cavity defines a receiving groove along a length direction of the side plate, and the other end of the rocker is received in the receiving groove and is capable of sliding along the receiving groove.

In one of the embodiments, the side plate further defines a guiding groove. An extending direction of the guiding groove is not parallel to an extending direction of the receiving groove. The connecting component further includes a positioning pin. The rocker defines a positioning hole. The positioning pin extends through the positioning hole. One end of the positioning pin is received in the guiding groove so that the positioning pin is capable of sliding along the guiding groove and guiding the rocker.

In one of the embodiments, the guiding groove extends through the side plate along a thickness direction of the side plate. The positioning pin includes a pin body and a flange at one end of the pin body. The pin body extends through the positioning hole and the guiding groove. The flange abuts against a surface of the side plate away from the receiving cavity, so that the pin body is capable of sliding along the receiving groove.

In one of the embodiments, from an end adjacent to the bottom plate to an end far away from the bottom plate, the two side plates each includes a first plate body and a second plate body. The receiving groove is located on the first plate body, and the guiding groove is located on the second plate body.

In one of the embodiments, a distance between two opposed first plate bodies is less than a distance between two opposed second plate bodies.

In one of the embodiments, the connecting component further includes a connecting rod. The connecting rod is rotatably connected to the other end of the rocker. The connecting rod is received in the receiving groove and is capable of sliding along the receiving groove. Two pulleys are provided. The two pulleys are respectively located at both ends of the pulley component in a length direction. Two rockers are provided. One ends of the two rockers are rotatably connected to the two pulleys, respectively, and the other ends of the two rockers are rotatably connected to both ends of the connecting rod, respectively.

In one of the embodiments, the pulley device further includes an adjusting component. The adjusting component is connected to the rocker, to drive the rocker to slide along the receiving groove.

In one of the embodiments, the adjusting component includes a fixing block and a push-pull rod. The fixing block is fixedly connected to the housing. One end of the push-pull rod is slidably connected to the fixing block, and the other end of the push-pull rod is connected to the rocker to drive the rocker to slide along the receiving groove.

In one of the embodiments, the fixing block and the push-pull rod are received in the receiving cavity. A surface of the fixing block facing the side plate is provided with a protrusion matching the receiving groove.

According to embodiments of the present disclosure, a sliding door is further provided. The sliding door includes the pulley device as described above.

According to embodiments of the present disclosure, a sliding window is further provided. The sliding window includes the pulley device as described above.

In the pulley device, the sliding door, and the sliding window according to the embodiments of the present disclosure, the pulley component is connected to the housing by the connecting component having the rocker, as such, the connecting structure is relatively simple, so that both the pulley component and the connecting component can be received in the receiving cavity within the housing. In addition, the position of the pulley component relative to the housing is adjustable. Moreover, the receiving groove is defined on the surface of the side plate of the housing facing the receiving cavity, so that one end of the rocker of the connecting component can be received in the receiving groove, which facilitates mounting. In this way, when the pulley component moves relative to the housing, the rocker can slide in the receiving groove. Under the premise of ensuring that the connecting component and the housing are firmly connected, the position of the pulley component can be adjusted smoother. As such, the pulley device has a simple overall structure, convenient mounting, and low production cost.

DETAILED DESCRIPTION OF THE EMBODIMENTS

Figure 1:
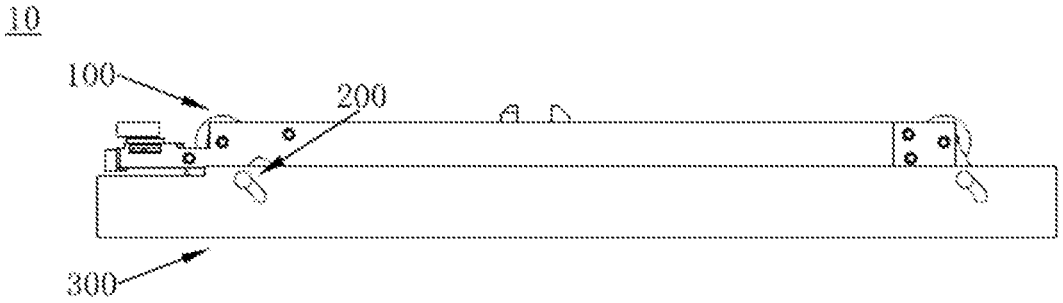
FIG. 1 is a schematic view of a pulley device according to an embodiment of the present disclosure.
Figure 2:
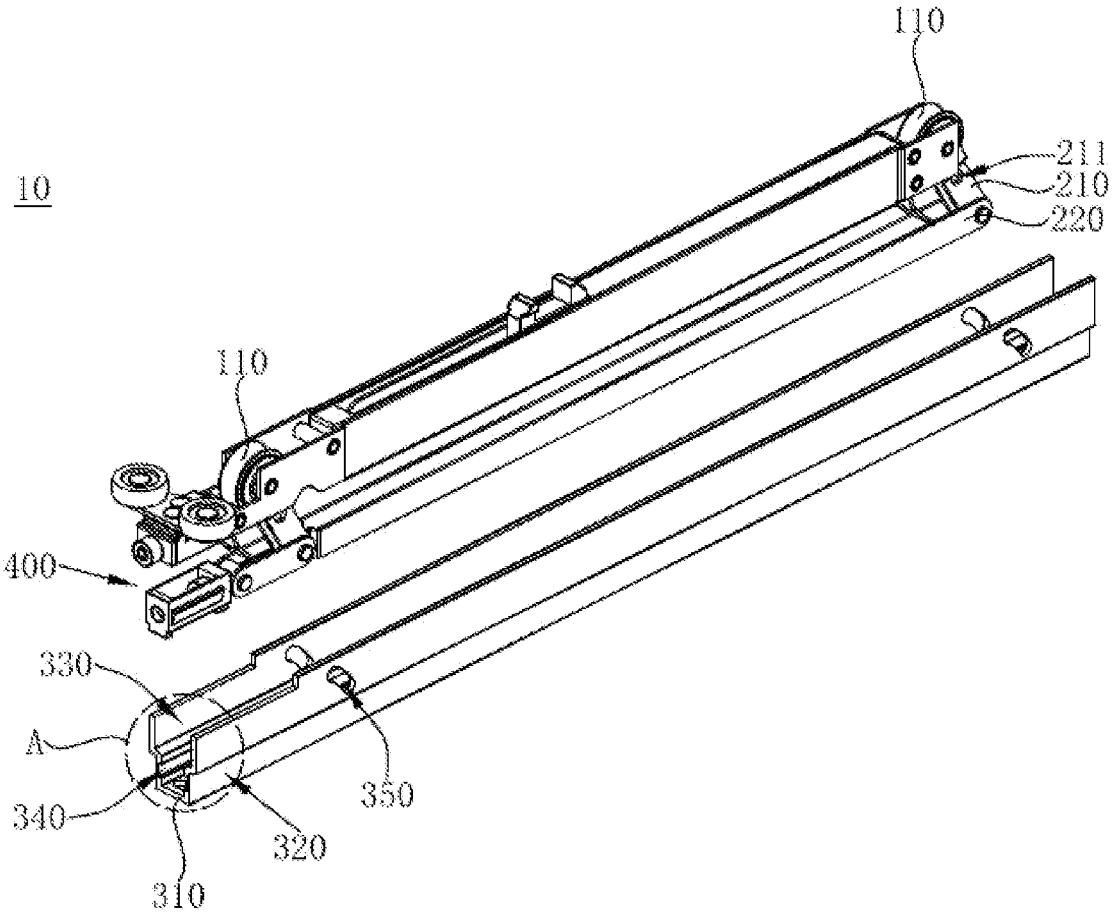
FIG. 2 is an exploded view of a pulley device according to an embodiment of the present disclosure.
Figure 3:
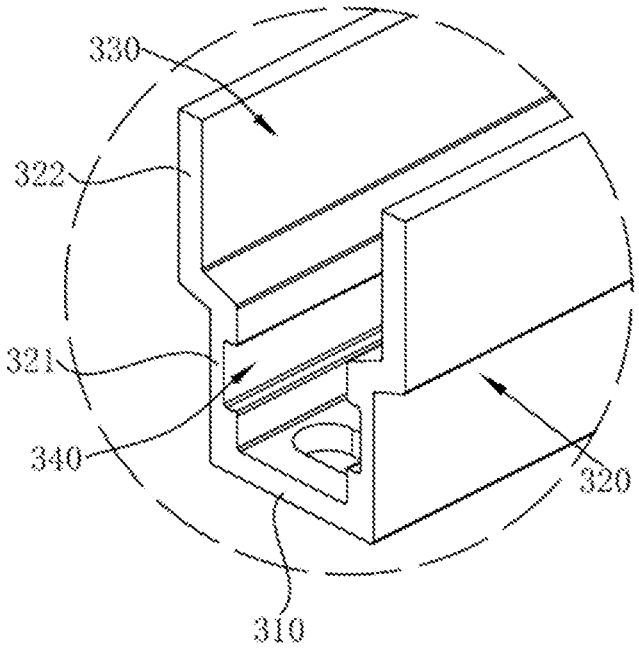
FIG. 3 is a partial enlarged schematic view of a portion A of FIG. 2.
Figure 4:
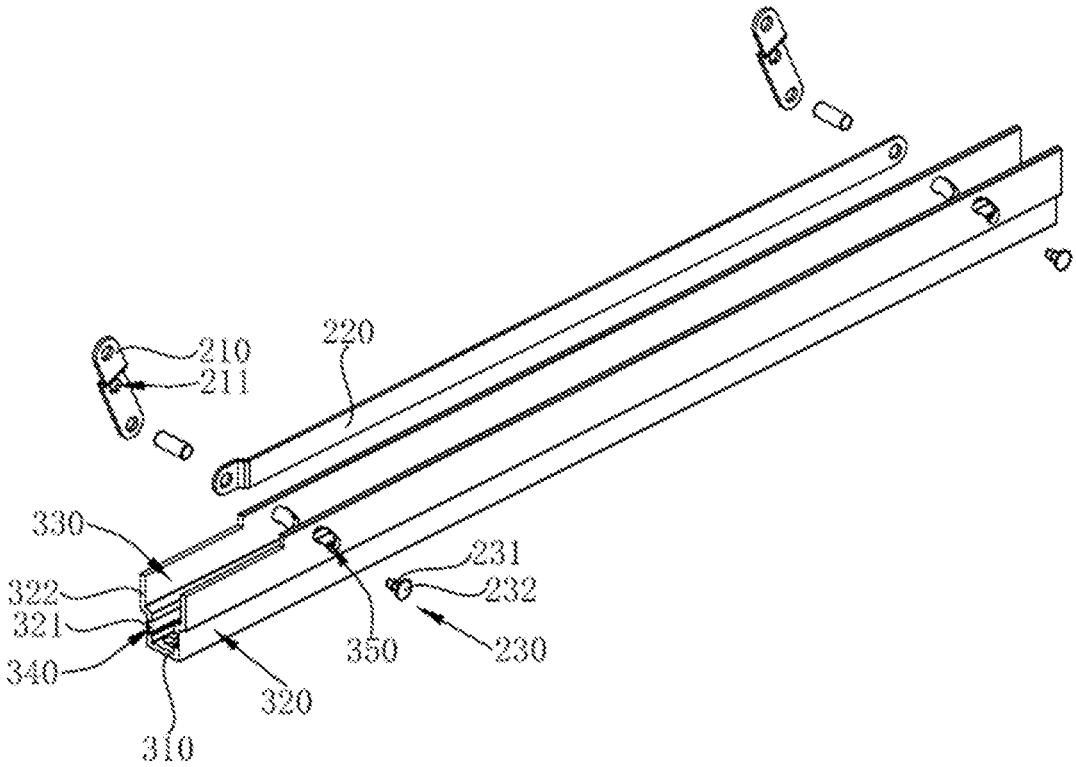
FIG. 4 is an exploded view of a connecting structure between a connecting component and a housing in a pulley device according to an embodiment of the present disclosure.
Figure 5:
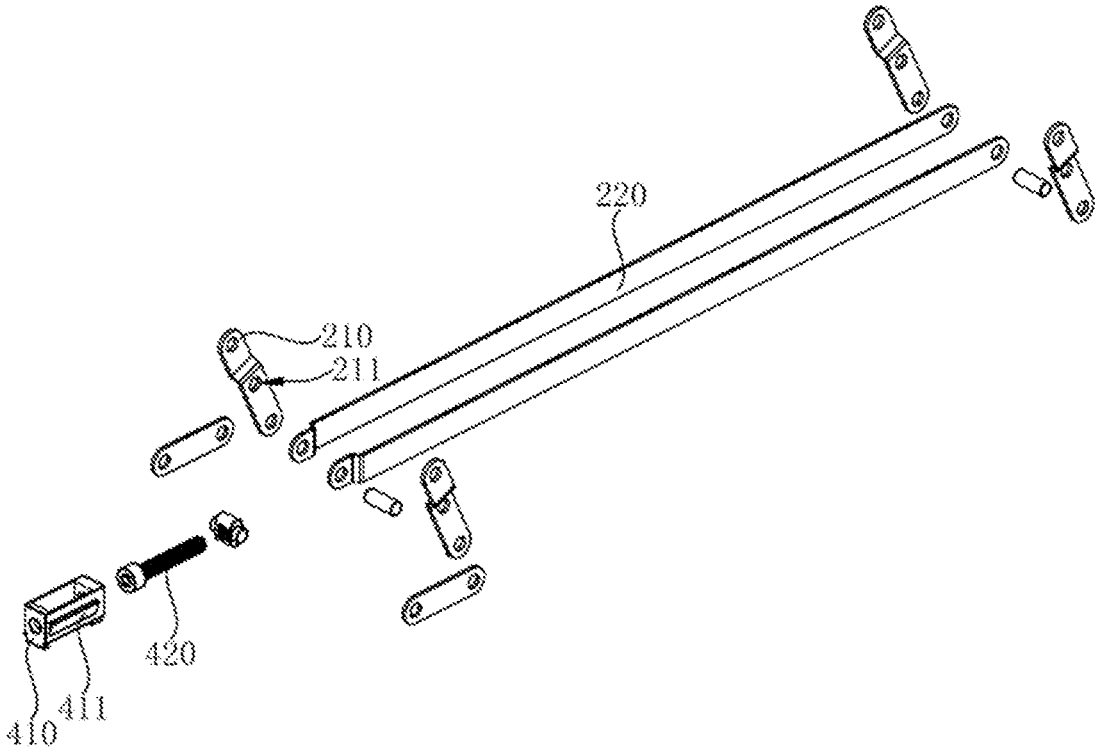
FIG. 5 is an exploded view of a connecting structure between a connecting component and an adjusting component in a pulley device according to an embodiment of the present disclosure.

In order to enable the above objects, features and advantages of the present disclosure more obvious and understandable, the specific embodiments of the present disclosure will be described in detail below with reference to the accompanying drawings. In the following description, many specific details are illustrated in order to aid in understanding of the present disclosure. However, the present disclosure can be implemented in many other ways different from those described herein, and those skilled in the art can make similar improvements without departing from the connotation of the present disclosure. Therefore, the present disclosure is not limited by the specific embodiments disclosed below.

It should be noted that when an element is referred to as being "fixed to" another element, it can be directly on another element or there may be an intermediate element therebetween. When an element is considered to be "connected to" another element, it can be directly connected to another element or there may be an intermediate element therebetween at the same time.

Unless otherwise defined, the technical and scientific terms used herein have the same meaning as commonly understood by those skilled in the technical field of the present disclosure. The terms used in the specification of the disclosure herein are only for the purpose of describing specific embodiments, and are not intended to limit the disclosure. As used herein, the term "and/or" includes any and all combinations of one or more associated listed items.

Referring to FIGS. 1 to 5, according to an embodiment of the present disclosure, a pulley device 10 is provided. The pulley device 10 includes a pulley component 100, a connecting component 200, and a housing 300. The pulley component 100 is connected and fixed to the housing 300 through the connecting component 200. A position of the pulley component 100 relative to the housing 300 can be adjusted.

The pulley component 100 includes a pulley 110. The pulley 110 may be mounted on a pulley frame. The pulley frame is a main structure used to mount and fix the pulley 110 and other parts in the pulley component 100. A structure of the pulley frame is not limited herein. In this embodiment, the pulley frame defines a mounting space therein. The pulley 110 is mounted in the mounting space, and is rotatably connected to the pulley frame by a pin. One side of the pulley frame further has an opening that is in communication with the mounting space. A portion of the pulley 110 protrudes out of the opening to be convenient for being connected with doors or windows. The number and mounting positions of the pulleys 110 can be flexibly adjusted according to different use requirements. As shown in the figure, two pulleys 110 are provided in this embodiment. The two pulleys 110 are respectively mounted on both ends of the pulley frame in a length direction thereof.

The pulley component 100 is connected and fixed to the housing 300 through a transmission assembly. The position of the pulley component 100 relative to the housing 300 is adjusted by the transmission assembly. Specifically, the connecting component 200 includes a rocker 210. One end of the rocker 210 is rotatably connected to the pulley frame 110. The other end of the rocker 210 is slidably connected to the housing 300. By providing the rocker 210, the pulley component 100 and the housing 300 can move relative to the rocker 210 respectively and maintain a stable connection relationship therebetween.

The housing 300 is used to connect, carry, and fix the pulley component 100 and the connecting component 200. The housing 300 includes a bottom plate 310 and two side plates 320. The two side plates 320 are respectively fixed on two opposite sides of the bottom plate 310 so that the bottom plate 310 and the side plates 320 jointly define a receiving cavity 330 for receiving the pulley component 100 and the connecting component 200. According to different processing techniques, the two side plates 320 in the housing 300 can be fixed on the bottom plate 310 by welding, riveting, and other methods commonly used in the art, or the two side plates 320 and the bottom plate 310 can be integrally formed. The size and shape of the receiving cavity 330 enclosed by the bottom plate 310 and the side plates 320 are not limited, as long as the receiving cavity 330 can completely receive the pulley component 100, the connecting component 200, and other parts or components of the pulley device 10. In addition, a surface of the side plate 320 facing the receiving cavity 330 defines a receiving groove 340 along a length direction of the side plate 320. Since the connecting component 200 is received in the receiving cavity 330 of the housing 300, the other end of the rocker 210 can also be further received in the receiving groove 340 on the side plate 320. By reasonably setting the shape and size of the receiving groove 340 to be respectively adapted to the ends of the rocker 210, the receiving groove 340 can limit and guide the rocker 210, enabling the rocker 210 to slide along the receiving groove 340.

In this way, the other end of the rocker 210 can be inserted into the receiving groove 340 from the end of the housing 300, so that the connecting component 200 and the housing 300 can be easily connected and fixed, which facilitates the mounting. Moreover, when the position of the pulley component 100 relative to the housing 300 is adjusted through the connecting component 200, due to that the receiving groove 340 can limit and guide the rocker 210, the movements of the connecting component 200 and the pulley component 100 are smooth, and the position of the pulley component 100 can be adjusted smoother.

In the pulley device 10 according to the embodiments of the present disclosure, the pulley component 100 is connected to the housing 300 by the connecting component 200 having the rocker 210, as such, the connecting structure is relatively simple, so that both the pulley component 100 and the connecting component 200 can be received in the receiving cavity 330 within the housing 300. In addition, the position of the pulley component 100 relative to the housing 300 is adjustable. Moreover, the receiving groove 340 is defined on the surface of the side plate 320 of the housing 300 facing the receiving cavity 330, so that one end of the rocker 210 of the connecting component 200 can be received in the receiving groove 340, which facilitates mounting. In this way, when the pulley component 100 moves relative to the housing 300, the rocker 210 can slide in the receiving groove 340. Under the premise of ensuring that the connecting component 200 and the housing 300 are firmly connected, the position of the pulley component 100 can be adjusted smoother. As such, the pulley device 10 has a simple overall structure, convenient mounting, and low production cost.

The receiving groove 340 on the side plate 320 can limit and guide the rocker 210. Moreover, in order to make the movement of the connecting component 200 easier to be adjusted and controlled, in one of the embodiments, the side plate 320 further defines a guiding groove 350. An extending direction of the guiding groove 350 is not parallel to an extending direction of the receiving groove 340. That is, the extending direction of the guiding groove 350 intersects the extending direction of the receiving groove 340. The connecting component 200 further includes a positioning pin 230. The rocker 210 defines a positioning hole 211. The positioning pin 230 extends through the positioning hole 211. One end of the positioning pin 230 is received in the guiding groove 350 so that the positioning pin 230 can slide along the guiding groove 350 and guide the rocker 210. The rocker 210 is respectively connected to the pulley component 100 and the housing 300 at two ends thereof, so the rocker 210 has a greater degree of freedom of movement. For this reason, in this embodiment, the rocker 210 is further connected to the side plate 320 at the middle thereof through the positioning pin 230. The positioning pin 230 and the guiding groove 350 can cooperate to limit the rocker 210, so that the rocker 210 moves within a specific range. In addition, the positioning pin 230 can slide in the guiding groove 350 along the extending direction of the guiding groove 350. As such, by properly setting the extending direction of the guiding groove 350, the pulley component 100 can be moved relative to the housing 300 within a specific range. In this embodiment, in order to enable the pulley component 100 to be lifted and lowered relative to the housing 300, that is, to change the extent to which the pulley component 100 protrudes out of the receiving cavity 330 within the housing 300, the rocker 210 is required to be capable of displacing in a height direction of the side plate 320. Therefore, the extending direction of the guiding groove 350 is not parallel to the extending direction of the receiving groove 340. In this way, when the positioning pin 230 slides along the guiding groove 350, the positioning pin 230 can slide in the height direction of the side plate 320, or has a sub-displacement in the height direction of the side plate 320.

Figure 6:
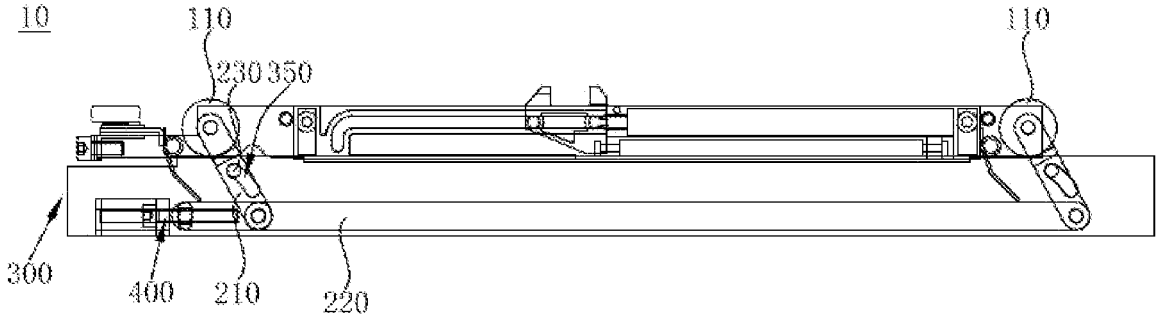
FIG. 6 is a perspective view of a pulley device according to an embodiment of the present disclosure, where the pulley device is in a first state.
Figure 7:
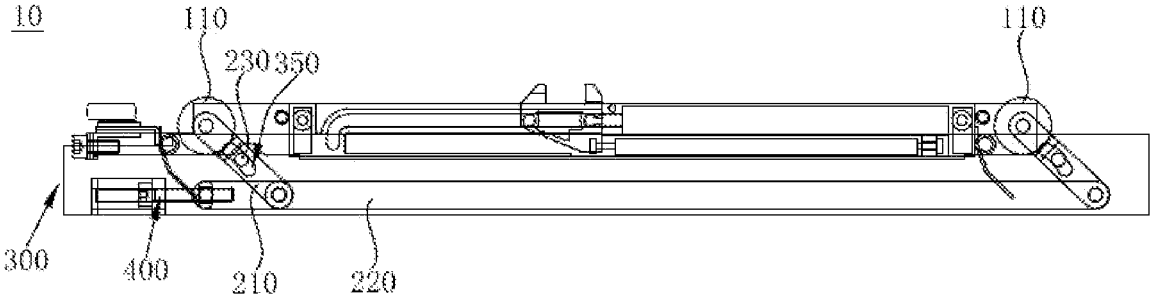
FIG. 7 is a perspective view of a pulley device according to an embodiment of the present disclosure, where the pulley device is in a second state.
Figure 8:
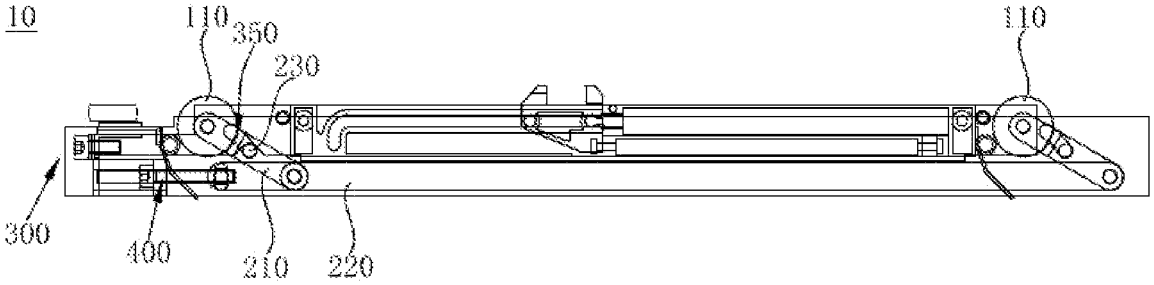
FIG. 8 is a perspective view of a pulley device according to an embodiment of the present disclosure, where the pulley device is in a third state.

Referring to FIGS. 6 to 8, which show the relative positional relationship between the components in the pulley device 10 when the pulley component 100 moves relative to the housing 300 to be in three different states. In FIG. 6, the positioning pin 230 is located at an extreme position of one end of the guiding groove 350. In this case, the pulley component 100 is in a first state. That is, the pulley component 100 has the largest protruding portion relative to the housing 300, and the pulley component 100 has the highest height. In FIG. 7, as the rocker 210 swings counterclockwise in the figure, the end of the rocker 210 adjacent to the housing 300 slides to the right side in the figure, and the positioning pin 230 also slides to the middle position of the guiding groove 350. In this case, the pulley component 100 is in a second state. That is, the pulley component 100 has a moderate protruding portion relative to the housing 300, and the pulley component 100 has a moderate height. In FIG. 8, as the rocker 210 further swings counterclockwise in the figure, the end of the rocker 210 adjacent to the housing 300 slides to the right side in the figure, and the positioning pin 230 also slides to the extreme position of the other end of the guiding groove 350, in this case, the pulley component 100 is in the third state. That is, the pulley component 100 has a smallest protruding portion relative to the housing 300, and the pulley component 100 has the lowest height. During the use of the pulley device 10, the position of the pulley component 100 can be adjusted according to the use requirements, so that the pulley component 100 can be in the above several different states to meet the use requirements in different scenarios.

The guiding groove 350 can have a structure similar to that of the receiving groove 340. That is, the guiding groove 350 is defined on the surface of the side plate 320 facing the receiving cavity 330. In this case, the positioning pin 230 extends through the positioning hole 211, and the end of the positioning pin 230 adjacent to the side plate 320 is received in the guiding groove 350. The guiding groove 350 may also have a structure different from that of the receiving groove 340. Referring to FIGS. 1 to 4, in one embodiment, the guiding groove 350 extends through the side plate 320 along the thickness direction of the side plate 320. The positioning pin 230 includes a pin body 231 and a flange 232 at one end of the pin body 231. The pin body 231 extends through the positioning hole 211 and the guiding groove 350. The flange 232 abuts against the surface of the side plate 320 away from the receiving cavity 330, so that the pin body 231 can slide along the receiving groove 340. The structure of the guiding groove 350 extending through the side plate 320 facilitates the mounting and fixation of the positioning pin 230 and the rocker 210, and also facilitates the user to adjust the state of the pulley component 100 by adjusting the position of the positioning pin 230, which is more convenient to use.

As described above, the receiving groove 340 and the guiding groove 350 are both defined on the side plate 320, but since the rocker 210 of the connecting component 200 are connected to the receiving groove 340 and the guiding groove 350 at different positions, the receiving groove 340 and the guiding groove 350 are located at different positions on the side plate 320. In one embodiment, from an end adjacent to the bottom plate 310 to an end far away from the bottom plate 310, the two side plates 320 each includes a first plate body 321 and a second plate body 322. That is, the first plate body 321 of the side plate 320 is directly connected to the bottom plate 310, and the second plate body 322 is connected to the bottom plate 310 through the first plate body 321. In addition, the receiving groove 340 is located on the first plate body 321, and the guiding groove 350 is located on the second plate body 322. In this way, the receiving groove 340 and the guiding groove 350 are disposed on the first plate body 321 and the second plate body 322, respectively, the heights of the receiving groove 340 and the guiding groove 350 relative to the bottom plate 310 are different to each other, so that the receiving groove 340 and the guiding groove 350 can better cooperate with the connecting component 200. It should be noted that the first plate body 321 and the second plate body 322 may be two separate plates that are connected by welding, riveting, and other methods commonly used in the art, or may also be connected by an additional connecting member or connecting plate. The first plate body 321 and the second plate body 322 can also be integrated to improve the structural integrity of the side plate 320 and reduce the processing difficulty of the side plate 320. As such, the first plate body 321 and the second plate body 322 are divided according to the function when they are connected. The actual structure of the side plate 320 does not have a boundary line for dividing the two plates. The size of the space occupied by the first plate body 321 and the second plate body 322 can be different from each other according to the actual use scenarios.

The bottom plate 310 and the two side plates 320 jointly define the receiving cavity 330 for receiving the pulley component 100 and the connecting component 200. Therefore, the size and shape of the receiving cavity 330 are directly related to the shapes of the two side plates 320 and the distance between the two side plates 320. In order to make the internal space of the pulley device 10 more compact, it is necessary to make full use of the space of the receiving cavity 330 in the housing 300. Therefore, in one of the embodiments, the distance between the two opposed first plate bodies 321 is less than the distance between the two opposed second plate bodies 322. Since the side plate 320 is divided into the first plate body 321 and the second plate body 322, the receiving cavity 330 is also divided into a first cavity enclosed by the two opposed first plate bodies 321, and a second cavity enclosed by the two opposed second plate bodies 322. The distance between the two opposed first plate bodies 321 is less than the distance between the two opposed second plate bodies 322, that is, the distance between the two opposed first plate bodies 321 is smaller, and the first cavity also has a relatively small space, which can receive a connecting rod 220 of the connecting component 200 without waste of space. The distance between the two opposed second plate bodies 322 is relatively large, and the second cavity also has a relatively large space, which can receive the pulley component 100 and other accessory components. It should be noted that the side plate 320 may be vertically connected to the bottom plate 310, that is, an angle between the side plate 320 and the bottom plate 310 is a right angle. The side plate 320 may also be inclinedly connected to the bottom plate 310, that is, the angle between the side plate 320 and the bottom plate 310 is an obtuse angle. The connection between the first plate body 321 and the bottom plate 310 and the connection between the second plate body 322 and the first plate body 321 can be flexibly selected from the above methods, as long as the requirement that the distance between the two opposed first plate bodies 321 is less than the distance between the two opposed second plate bodies 322 can be satisfied.

In order to further strengthen the stability of the movement of the pulley component 100 relative to the housing 300 when being adjusted, in one of the embodiments, the connecting component 200 further includes the connecting rod 220. The connecting rod 220 is rotatably connected to the other end of the rocker 210, and thus the connecting rod 220 is received in the receiving groove 340 and can slide along the receiving groove 340. Two pulleys 110 are provided. The two pulleys 110 are respectively located at both ends of the pulley component 100 in the length direction. In addition, two rockers 210 are provided. One ends of the two rockers 210 are rotatably connected to the two pulleys 110, respectively, and the other ends of the two rockers 210 are rotatably connected to both ends of the connecting rod 220, respectively. That is, at each of both ends of the connecting rod 220, one rocker 210 is rotatably connected to the connecting rod 220, and the two rockers 210 are respectively rotatably connected to the pulleys 110 at both ends of the pulley component 100 in the length direction. In this way, both ends of the pulley component 100 are connected and fixed to the housing 300. The stability is better when the pulley component 100 moves. It should be noted that, in order to simplify the structure and reduce the cost, one connecting rod 220 may be disposed in the connecting component 200. In this case, it is only necessary to define the receiving groove 340 on one of the two side plates 320 adjacent to the connecting rod 220 after mounting and connecting the connecting component 200 and the housing 300, and the connecting rod 220 is received in the receiving groove 340. In order to make the connection of the connecting component 200 more stable and the movement of the pulley component 100 to be smoother, as shown in this embodiment, two connecting rods 220 may be correspondingly disposed on both sides of the pulley component 100. In this case, the two side plates 320 respectively defines the receiving grooves 340, and the two connecting rods 220 are respectively received in the respective two receiving grooves 340.

In the above embodiments, the position of the pulley component 100 can be adjusted by adjusting and control the position of the positioning pin 230 in the guiding groove 350. For the user to adjust the position of the pulley component 100 more simply, conveniently, and accurately, referring to FIGS. 1, 2 and 5, in one of the embodiments, the pulley device 10 further includes an adjusting component 400. The adjusting component 400 is fixedly connected to the rocker 210, to drive the rocker 210 to slide along the receiving groove 340. In this embodiment, by providing the adjusting component 400 fixedly connected to the rocker 210, the adjusting component 400 can be used to directly push or pull the rocker 210 to slide in the receiving groove 340, or the adjusting component 400 can be used to push or pull the connecting rod 220, to drive the rocker 210 to move and finally drive the pulley component 100 to move. As such, the position of the pulley component 100 can be adjusted. Since the position and structural design of the adjusting component 400 are beneficial to the operation of the user, the use of the adjusting component 400 can enable the user to adjust the position of the pulley component 100 more simply and conveniently. As such, it is convenient to adjust the position of the pulley component 100, thereby facilitating more precise adjustment of the pulley component 100.

Specifically, the adjusting component 400 includes a fixing block 410 and a push-pull rod 420. The fixing block 410 is fixedly connected to the housing 300. One end of the push-pull rod 420 is slidably connected to the fixing block 410. The other end of the push-pull rod 420 is connected to the rocker 210 to drive the rocker 210 to slide along the receiving groove 340. Furthermore, the fixing block 410 and the push-pull rod 420 are both received in the receiving cavity 330. A protrusion 411 matching the receiving groove 340 is provided on the surface of the fixing block 410 facing the side plate 320. By disposing the protrusion 411 on the surface of the fixing block 410 to match the receiving groove 340, it is convenient to mount the fixing block into the receiving groove 340 to fix it to the housing 300, so that the sliding of the push-pull rod 420 can be limited and guided, and the movement of the push-pull rod 420 is more stable.

An embodiment of the present disclosure further provides a sliding door, which includes the pulley device 10 according to any one of the above embodiments. Another embodiment of the present disclosure further provides a sliding window, which includes the pulley device 10 according to any one of the above embodiments.

By adopting the pulley device 10 according to the above embodiments in the sliding door or window, the connection structure in the sliding door or the sliding window is relatively simple. Both the pulley component 100 and the connecting component 200 can be received in the receiving cavity 330 in the housing 30, and the positions of the pulley component 100 relative to the housing 300 is adjustable. In addition, the receiving groove 340 is defined on the surface of the side plate 320 of the housing 300 facing the receiving cavity 330, and one end of the rocker 210 of the connecting component 200 can be received in the receiving groove 340, which facilitates mounting. In this way, when the pulley component 100 moves relative to the housing 300, the rocker 210 can slide in the receiving groove 340. Under the premise of ensuring that the connecting component 200 and the housing 300 are firmly connected, the position of the pulley component 100 can be adjusted smoother. The pulley device 10 has a simple overall structure, convenient mounting, and low production cost.

The technical features of the above-described embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

What is claimed is:

1. A wheel device, comprising:

a wheel component comprising a wheel;

a connecting component comprising a rocker, one end of the rocker being rotatably connected to the wheel component; and a housing comprising a bottom plate and two side plates, the two side plates being fixed to two opposed sides of the bottom plate, respectively, so that the bottom plate and the side plates jointly define a receiving cavity configured to receive the wheel component and the connecting component, wherein a surface of each side plate facing the receiving cavity defines a receiving groove along a length direction of each side plate, and a second end of the rocker is received in the receiving groove and is capable of sliding along the receiving groove;

wherein each side plate further defines a guiding groove, an extending direction of the guiding groove is not parallel to an extending direction of the receiving groove;

the connecting component further comprises a positioning pin, the rocker defines a positioning hole; the positioning pin extends through the positioning hole; one end of the positioning pin is received in the guiding groove so that the positioning pin is capable of sliding along the guiding groove and guiding the rocker;

wherein the guiding groove extends through each side plate along a thickness direction of each side plate; the positioning pin comprises a pin body and a flange at one end of the pin body; the pin body extends through the positioning hole and the guiding groove; the flange abuts against a surface of each side plate away from the receiving cavity, so that the pin body is capable of sliding along the receiving groove.

2. The wheel device according to claim 1, wherein from the two side plates each comprises a first plate body and a second plate body; the receiving groove is located on each of the first plate bodies, and the guiding groove is located on each of the second plate bodies.

3. The wheel device according to claim 2, wherein a distance between two opposed first plate bodies is less than a distance between two opposed second plate bodies.

4. The wheel device according to claim 1, wherein the connecting component further comprises a connecting rod; the connecting rod is rotatably connected to the second end of the rocker, and the connecting rod is received in the receiving groove and is capable of sliding along the receiving groove;

two wheels are provided; the two wheels are respectively located at both ends of the wheel component in a length direction; two rockers are provided; first ends of the two rockers are rotatably connected to the two wheels, respectively, and second ends of the two rockers are rotatably connected to both ends of the connecting rod, respectively.

5. The wheel device according to claim 1, further comprising an adjusting component, wherein the adjusting component is connected to the rocker, to drive the rocker to slide along the receiving groove.

6. The wheel device according to claim 5, wherein the adjusting component comprises a fixing block and a push-pull rod; the fixing block is fixedly connected to the housing; one end of the push-pull rod is slidably connected to the fixing block, and the other end of the push-pull rod is connected to the rocker to drive the rocker to slide along the receiving groove.

7. The wheel device according to claim 6, wherein the fixing block and the push-pull rod are received in the receiving cavity; each surface of the fixing block facing one of the side plates is provided with a protrusion received in the receiving groove of each respective side plate.

8. A sliding door, comprising the wheel device according to claim 1.

9. A sliding window, comprising the wheel device according to claim 1.

10. A wheel device, comprising:

a wheel component comprising a wheel;

a connecting component comprising a rocker, one end of the rocker being rotatably connected to the wheel component; and a housing comprising a bottom plate and two side plates, the two side plates being fixed to two opposed sides of the bottom plate, respectively, so that the bottom plate and the side plates jointly define a receiving cavity configured to receive the wheel component and the connecting component, wherein a surface of each side plate facing the receiving cavity defines a receiving groove along a length direction of each side plate, and a second end of the rocker is received in the receiving groove and is capable of sliding along the receiving groove;

wherein each side plate further defines a guiding groove, an extending direction of the guiding groove is not parallel to an extending direction of the receiving groove;

the connecting component further comprises a positioning pin, the rocker defines a positioning hole; the positioning pin extends through the positioning hole; one end of the positioning pin is received in the guiding groove so that the positioning pin is capable of sliding along the guiding groove and guiding the rocker;

wherein the two side plates each comprises a first plate body and a second plate body; the receiving groove is located on each of the first plate bodies, and the guiding groove is located on each of the second plate bodies.

11. The wheel device according to claim 10, wherein a distance between two opposed first plate bodies is less than a distance between two opposed second plate bodies.

12. The wheel device according to claim 10, further comprising an adjusting component, wherein the adjusting component is connected to the rocker, to drive the rocker to slide along the receiving groove.

13. A sliding door, comprising the wheel device according to claim 10.

14. A sliding window, comprising the wheel device according to claim 10.

15. A wheel device, comprising:

a wheel component comprising a wheel;

a connecting component comprising a rocker, one end of the rocker being rotatably connected to the wheel component; and a housing comprising a bottom plate and two side plates, the two side plates being fixed to two opposed sides of the bottom plate, respectively, so that the bottom plate and the side plates jointly define a receiving cavity configured to receive the wheel component and the connecting component, wherein a surface of each side plate facing the receiving cavity defines a receiving groove along a length direction of each side plate, and a second end of the rocker is received in the receiving groove and is capable of sliding along the receiving groove;

wherein the connecting component further comprises a connecting rod; the connecting rod is rotatably connected to the second end of the rocker, and the connecting rod is received in the receiving groove and is capable of sliding along the receiving groove;

two wheels are provided; the two wheels are respectively located at both ends of the wheel component in a length direction; two rockers are provided; first ends of the two rockers are rotatably connected to the two wheels, respectively, and second ends of the two rockers are rotatably connected to both ends of the connecting rod, respectively.

16. The wheel device according to claim 15, further comprising an adjusting component, wherein the adjusting component is connected to the rocker, to drive the rocker to slide along the receiving groove.

17. A sliding door, comprising the wheel device according to claim 15.

18. A sliding window, comprising the wheel device according to claim 15.

* * * * *